US007311821B2

(12) United States Patent
Queirel

(10) Patent No.: US 7,311,821 B2
(45) Date of Patent: Dec. 25, 2007

(54) WATER CIRCULATION UNIT WITH INCREASED THROUGHPUT FOR SWIMMING POOLS, AND FILTER UNIT COMPRISING THE SAME

(76) Inventor: Joël Queirel, 39, rue Lebocey, F-10000 Troyes (FR)

( * ) Notice: Subject to any disclaimer, the term of this patent is extended or adjusted under 35 U.S.C. 154(b) by 0 days.

(21) Appl. No.: 10/558,392

(22) PCT Filed: Apr. 27, 2004

(86) PCT No.: PCT/FR2004/001019

§ 371 (c)(1),
(2), (4) Date: May 11, 2006

(87) PCT Pub. No.: WO2004/109042

PCT Pub. Date: Dec. 16, 2004

(65) Prior Publication Data

US 2006/0289344 A1 Dec. 28, 2006

(30) Foreign Application Priority Data

May 28, 2003 (FR) ..... 03 06532
Nov. 19, 2003 (FR) ..... 03 13553

(51) Int. Cl.
*E04H 4/12* (2006.01)
*E04H 4/16* (2006.01)

(52) U.S. Cl. ..... 210/167.12; 210/232; 210/259; 210/416.2; 4/507

(58) Field of Classification Search ..... 210/167.1, 210/167.12, 232, 416.1, 252, 416.2, 259; 4/507

See application file for complete search history.

(56) References Cited

U.S. PATENT DOCUMENTS 1,157,692 A 10/1915 Hayes
3,444,575 A 5/1969 Martin
3,961,393 A 6/1976 Pansini
4,168,705 A * 9/1979 Raab ..... 601/169
4,815,942 A * 3/1989 Alperin et al. ..... 417/167
4,818,389 A 4/1989 Tobias et al.
4,826,591 A 5/1989 Macia (Continued)

FOREIGN PATENT DOCUMENTS

JP 6-218393 * 8/1994

(Continued)

*Primary Examiner*—Fred G. Prince
(74) *Attorney, Agent, or Firm*—Young & Thompson

(57) ABSTRACT

A water circulation unit includes an ejector (142), a convergent, and a pipe (146) which is arranged in the extension of the convergent. The ejection axis practically merges with the symmetry axis of the convergent, the two axes forming a common axis of the unit, and the distance between the water outlet of the ejector (142) and the downstream section of the convergent is between 0.4 and 1.6 times the length of the convergent. A guiding region is located just upstream of the upstream section of the convergent following the common axis, at least up to the water outlet of the ejector (142) when the outlet is located outside the convergent, the region ensuring that the water is essentially symmetrically guided around the common axis during the operation of the ejector. In a filter unit, a cartridge (154) is arranged around the water circulation unit.

40 Claims, 8 Drawing Sheets

U.S. PATENT DOCUMENTS

| | | | | |
|---|---|---|---|---|
| 5,352,358 | A | 10/1994 | Davey | |
| 6,007,714 | A | 12/1999 | Keith | |
| 6,022,481 | A * | 2/2000 | Blake | 210/776 |
| 6,438,993 | B2 * | 8/2002 | Takeuchi et al. | 62/500 |
| 2002/0178837 | A1 * | 12/2002 | Brandt, Jr. | 73/861.63 |

FOREIGN PATENT DOCUMENTS

| | | | |
|---|---|---|---|
| WO | WO 95/08683 | * | 3/1995 |
| WO | WO 03/062561 | | 7/2003 |

* cited by examiner

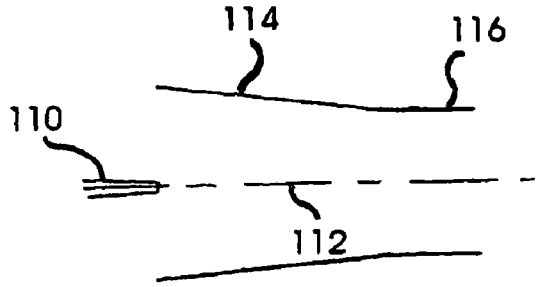
FIG. 6A
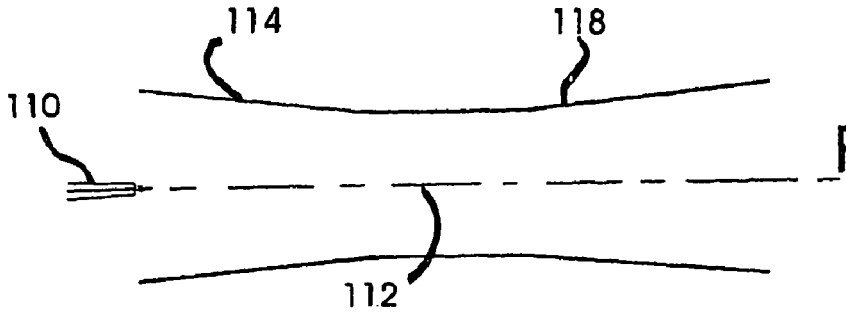
FIG. 6B
FIG. 6C
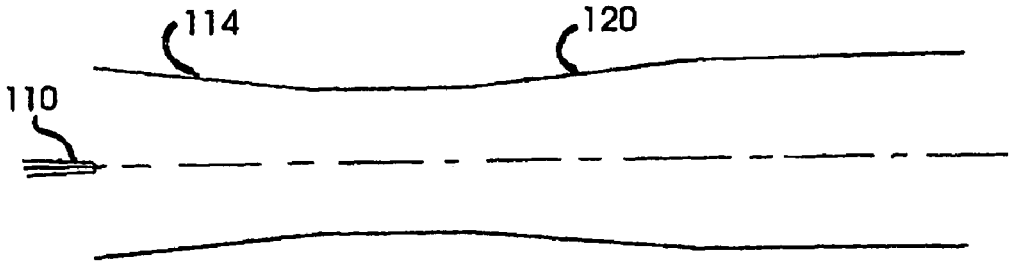
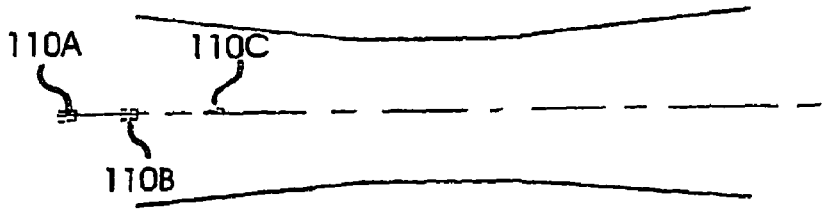
FIG. 6D

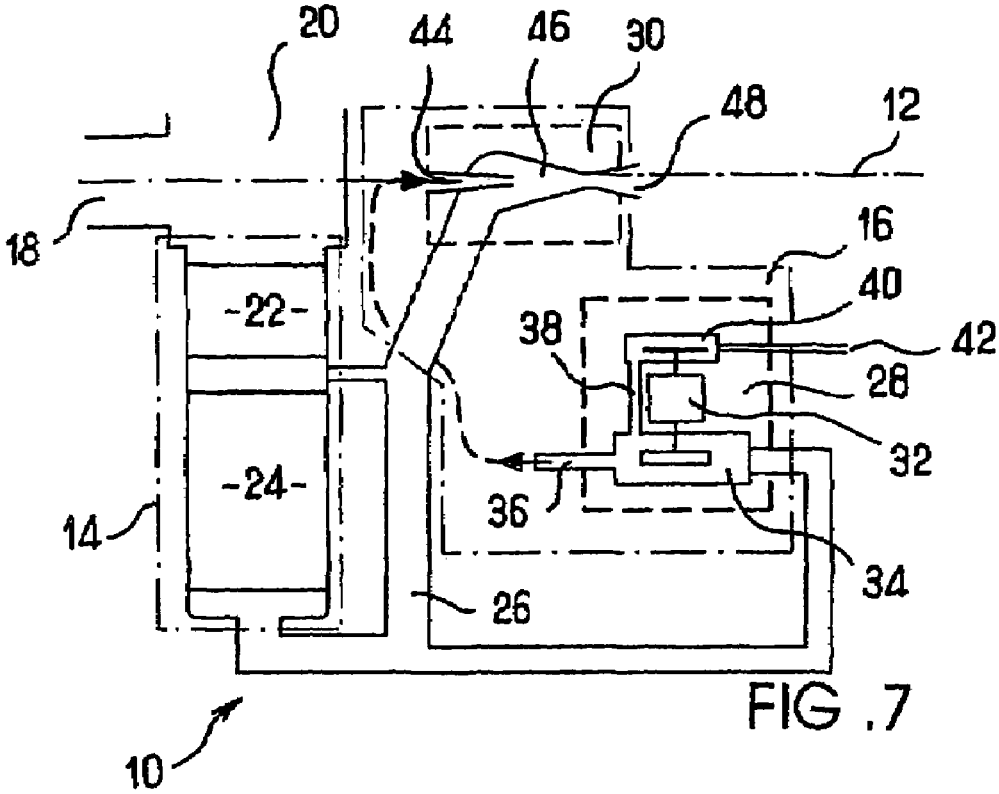
FIG .7
FIG. 8
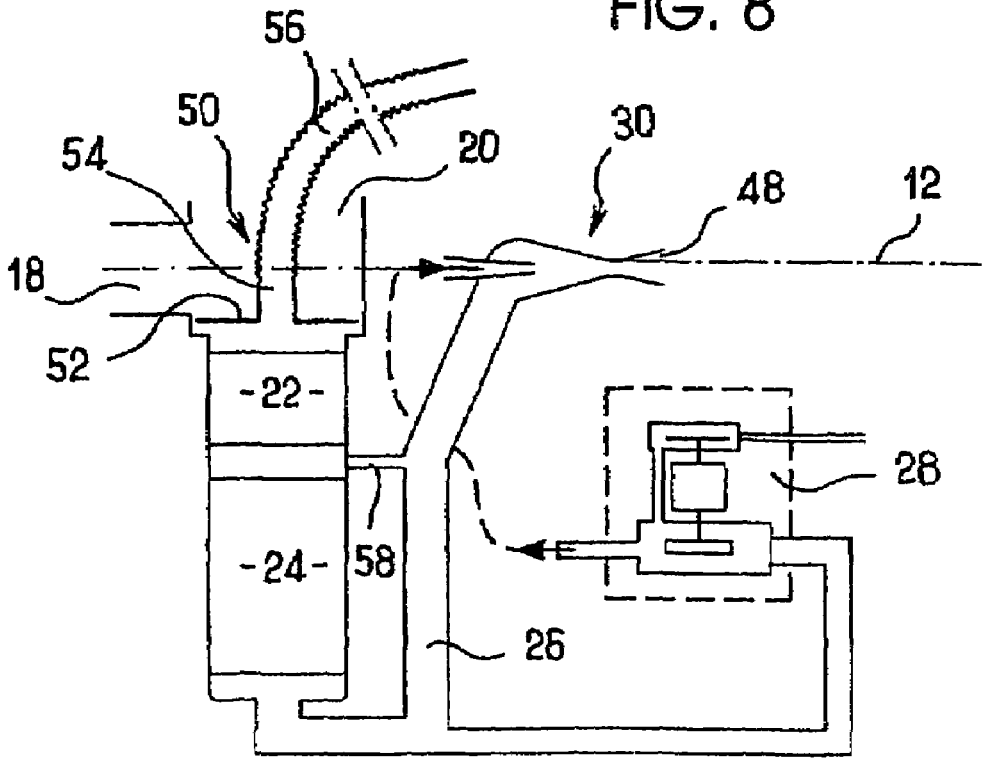

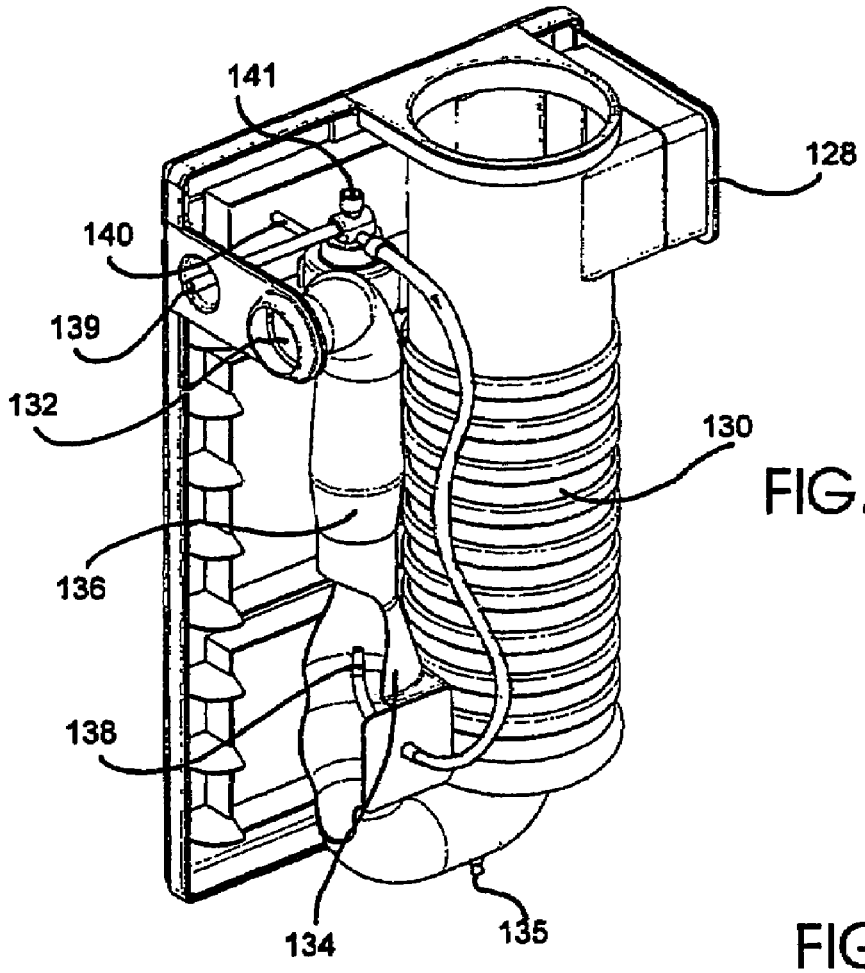
FIG. 15
FIG. 16
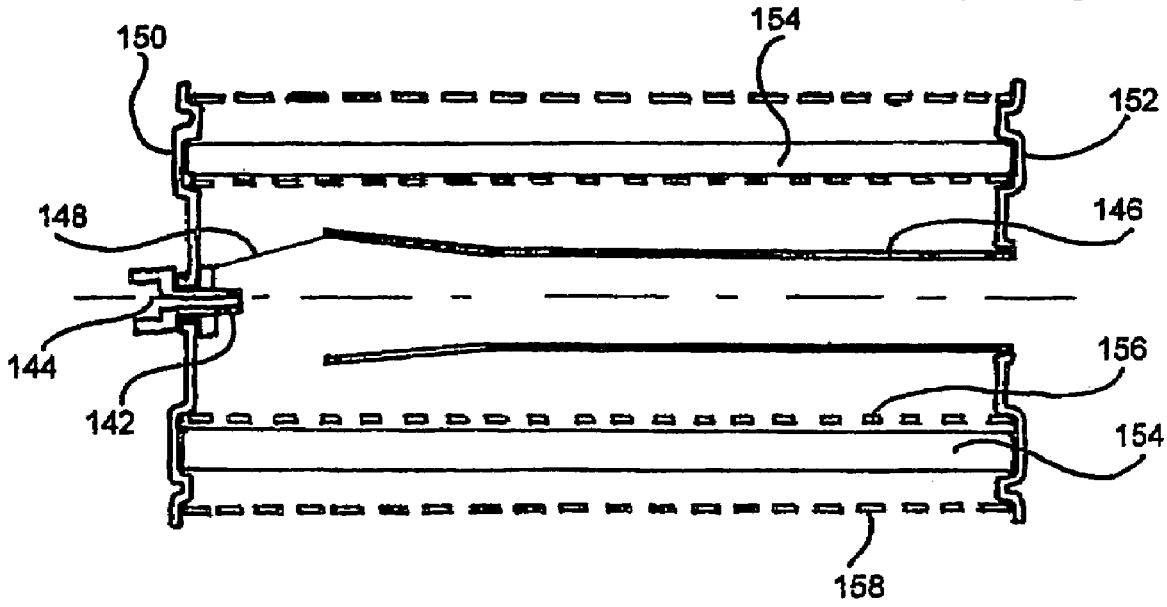

WATER CIRCULATION UNIT WITH INCREASED THROUGHPUT FOR SWIMMING POOLS, AND FILTER UNIT COMPRISING THE SAME

The present invention relates to a flow-multiplier water circulation assembly for a swimming pool, in particular for use in a swimming pool filter and maintenance group that is movable or a fixture, the invention also relates to a swimming pool maintenance and cleaner head, and even to a swimming pool cleaner robot.

To multiply flow rate, the invention essentially makes use of a system in which an ejector projects a flow of water into a converging portion.

BACKGROUND OF THE INVENTION

Attempts have already been made to use a flow-multiplier effect by projecting a flow of water directed towards a nozzle, an orifice, or a cone for the purpose of entraining water and thus obtaining a high flow rate for water circulation.

Thus, document U.S. Pat. No. 4,501,659 describes an appliance for circulating water in a swimming pool so as to enable the water to be filtered. As shown in accompanying FIG. 1, which reproduces a figure of that document, the top portion of the appliance comprises a filter and the bottom portion of the appliance is connected to a supply of water under pressure and includes a nozzle assembly directed towards an outlet opening in a facing wall. A converging portion or spout may be placed facing the ejector. It is located towards the bottom of the appliance. Water that has passed through the filter approaches the ejector from one side thereof and changes in direction in order to pass into the spout. The flow-multiplication factor that is obtained is relatively small, and it never exceeds 2.5.

Document U.S. Pat. No. 4,826,591 also describes a swimming pool filter installation, as shown in accompanying FIG. 2, which reproduces a figure of that document, in which installation a pump causes a flow of swimming pool water to circulate through a filter. Before returning to the swimming pool, the water passes through an ejector or restricted nozzle placed in front of a converging portion or entrainment nozzle so that the water which has come through a basket connected to a skimmer is sucked in by the converging portion. In that system, the flow obtained by multiplication is not used for circulation through a filter, but only through a basket for stopping debris such as leaves. As in the preceding document, the ejector and the converging portion are placed close to a bottom surface of a space whose top portion houses the basket. As indicated by arrows, the water moves down towards the inlet of a converging portion disposed horizontally, where it changes direction. Although the body of that document does not specify the multiplication ratio obtained with such a system, the values given for the various dimensions correspond to a multiplication factor that is small, certainly not exceeding 2.5.

Document U.S. Pat. No. 5,785,846 also describes an installation, as shown in accompanying FIG. 3, which reproduces a figure of that document, in which installation a pump feeds an ejector that projects a flow of water towards a duct facing it and in alignment therewith and disposed in a chamber that defines a rounded converging portion leading to the inlet of the duct. The suction effect created by the ejector in the converging portion is used for sucking in water that has passed through a filter and that arrives via a duct opening out into the side of the chamber surrounding the ejector. As shown in that figure, the flow of water coming from the filter arrives on one side of the ejector and is subjected to a change in direction through 90° in order to be entrained towards the outlet duct. Although the document gives no value for the flow-multiplication factor, the highly asymmetrical water inlet certainly puts a limit on the flow-multiplication factor at well below 2.5.

Document WO 02/086259 describes a flow-multiplier water circulation assembly, part of which is shown in accompanying FIG. 4 which reproduces one of the figures of that document, which assembly gives a multiplication factor greater than 2.5, and that can even exceed 3. That flow-multiplier assembly comprises a converging portion, a throat, and a diverging portion, and water under pressure is injected in a direction that is parallel to the inside surface of the throat through a slot disposed at the periphery of the throat. That system is limited to injecting water into the throat, and given the great length of the slot formed around the throat, the slot must be very narrow; in practice, it is found that it is easily clogged, unless appropriate precautions are taken to ensure that it does not become clogged.

Document WO 03/062561 which in the context of the present invention should be taken into consideration only under EPC Article 54(3) [prior filing date], describes an improvement to the system disclosed in the preceding document. As shown in accompanying FIG. 5, which reproduces one of the figures of document WO 03/062561, that system comprises an assembly having a converging portion, a throat, and a diverging portion including a first ejector disposed at the inlet to the converging portion, and a second ejector disposed in the throat. That system thus combines two injections, firstly via an ejector on the axis of the converging portion, the throat, and the diverging portion, and subsequently by the throat ejector. In addition, that document states that the upstream ejector placed on the axis of the converging portion may be located inside a Kaplan bend so as to enable a high flow-multiplication ratio to be obtained. As indicated in the figure, a flow at a rate of 10 cubic meters per hour ($m^3/h$) inserted half into the upstream ejector and half into the throat ejector gives an outlet flow at a rate of 30 $m^3/h$, i.e. that the flow-multiplication ratio is equal to 3.

SUMMARY OF THE INVENTION

It has been found that in the application to which the above-cited document relates, i.e. circulating water with flow-multiplication for a swimming pool, it is possible to obtain flow-multiplication ratios that are much greater than 3, being of the order of 10 or even more, by using technical means that are particularly simple.

There follows a description with reference to FIGS. 6A to 6D of experiments that have been carried out to demonstrate the effectiveness of the simple technical means implemented in the invention.

An ejector 110 was placed inside a swimming pool at a distance from its surface, bottom, and walls, the ejector 110 serving to direct water horizontally at a flow rate of 2 $m^3/h$ at a pressure of 2 bar. The speed of the water at the outlet form the ejector was about 1.7 meters per second (m/s). In the horizontal position, centered on the axis 112 of the ejector, there was disposed an element constituted by a converging portion 114 and a cylindrical duct 116. The section of the converging portion and the section of the duct were circular, going from an upstream section of the converging portion to a downstream section thereof and on to an outlet section of the duct, such that the assembly formed a surface of revolution. The outlet orifice from the ejector was placed in the plane of the upstream section of the converging portion.

In the experiment shown in FIG. 6A, the duct 116 connected to the converging portion 114 had a length equal to 40% of the length of the converging portion 114. In the experiment of FIG. 6B, the duct portion 116 was doubled in length and extended by a diverging portion, such that the duct 118 had a length equal to 1.75 times the length of the converging portion 114. Finally, in the experiment of FIG. 6C, the FIG. 6B duct 118 was extended by a cylindrical duct of length equal to 1.25 times the length of the converging portion, such that the duct 120 had a total length equal to about 3 times the length of the converging portion 114. The section of the smallest section portion, i.e. in the cylindrical duct portion 116 was 57 square centimeters ($cm^2$).

The ejector 110 was fed with water at a rate of 2 $m^3/h$ at a pressure of 2 bar, and the flow rate and the speed were measured at the outlet from the duct 116, 118, or 120. It was found that with the setup of FIG. 6A, a flow rate of 12 $m^3/h$ was obtained, with the setup of FIG. 6B, a flow rate of 21 $m^3/h$ was obtained, and with the setup of FIG. 6B, a flow rate of 24 $m^3/h$ was obtained. It can thus be seen that respective multiplication factors of 6, 10.5, and 12 were obtained. These factors are much greater than those obtained with the devices of the prior art.

To obtain more precise results, experiments were performed as shown diagrammatically in FIG. 6D. The device was analogous to that of FIG. 6B, but the ejector 110 was placed in three positions 110A, 110B, and 110C, with the position 110B corresponding to the position shown in FIG. 6B, the position 110A being outside the converging portion, at a distance equal to 45% of the length of the converging portion, and the position 110C corresponding to a position inside the converging portion, at 45% of the length of said converging portion.

In all three cases, to within the accuracy of measurement, a multiplication factor was obtained that was practically unchanged, lying in the range 10 to 11.

It can thus be seen that with the extremely sample means as shown, it is possible firstly to obtain very high flow-multiplication factors, and secondly to obtain such high factors in a manner that leaves a broad margin for adjusting the positions of the elements used in the longitudinal direction.

Additional experiments were then performed to determine why it is not possible to obtain high multiplication factors in the prior art devices. It was then found that when the axis of the ejector is not in alignment with the axis of the converging portion and of the duct, then the multiplication factor is greatly reduced. It was also found that any asymmetrical disposition at the inlet to the converging portion leads to a great reduction in the multiplication factor.

Thus, in the operating conditions of the swimming pools taken into consideration (volume lying in the range about 20 cubic meters ($m^3$) to 200 $m^3$), i.e. under conditions in which it is necessary to obtain a relatively high flow rate of several cubic meters to several tens of cubic meters per hour (e.g. in the range 5 $m^3/h$ to 50 $m^3/h$) at a water speed that is relatively high (e.g. 0.1 m/s to 2 m/s), a fundamental factor in obtaining a high multiplication factor is a symmetrical flow of water at the outlet from the ejector and at the inlet of the converging portion.

In the experiments described with reference to FIGS. 6A to 6D, precautions were taken for the setup to be located within a large mass of water so as to make it possible to consider that mass as being infinite around the ejector at the inlet of the converging portion. The water could therefore behave in perfectly symmetrical manner around the ejector and the converging portion. As soon as any asymmetry was introduced, the flow of water was greatly disturbed and the kinetic energy of the flow projected by the ejector dissipated rapidly on entering the converging portion, and even sooner by disturbance to the flow of water.

Amongst all of the documents cited above, only the fifth corresponds in part to the conditions of the invention. According to that document WO 03/062561, one ejector is disposed upstream from a converging portion, and at the inlet to the converging portion and also around the ejector, good water flow symmetry is obtained by using a Kaplan bend. However, the device described in that document does not suggest the invention, firstly since there is still fluid injection into the throat, and secondly since the alignment of the ejector on the axis of the converging portion, the throat, and the diverging portion was not properly understood, as can be seen from the results obtained (multiplication factor limited to 3).

An object of the invention is to implement the above characteristics to obtain a high multiplication ratio; it makes it possible to use low flow rate pumps to obtain simultaneously a large circulation flow rate, filtering of a large volume of water, and sufficient stirring of the water in a swimming pool to ensure that particles do not become deposited, so that the bottom of the swimming pool remains clean and the amount of cleaning it requires is greatly reduced.

More precisely, the invention provides a flow-multiplier water circulation assembly for a swimming pool, of the type that includes a water inlet, the assembly comprising:

an ejector connected to the water inlet and having a water outlet for projecting water along an ejection axis;

a converging portion having an axis of symmetry and a section perpendicular to said axis that decreases from an upstream section to a downstream section, and presenting a length between the upstream and downstream sections;

a duct disposed in line with the converging portion to which it is connected without internal discontinuity at the downstream section of the converging portion, the duct presenting a length between the downstream section of the converging portion and an outlet, the section of the duct not decreasing in practice along its length, and the length of the duct being not less than one-third the length of the converging portion;

the ejection axis practically coinciding with the axis of symmetry of the converging portion, and the two axes together forming a common axis of the assembly;

the distance between the water outlet of the ejector and the downstream section of the converging portion lying in the range 0.4 times to 1.6 times the length of the converging portion; and a guide space disposed immediately upstream from the upstream section of the converging portion on the common axis, and at least as far as the water outlet from the ejector when the outlet is outside the converging portion, said space serving to guide water in practically symmetrical manner around the common axis.

Preferably, the axis of symmetry of the converging portion is an axis of circular symmetry. In an advantageous embodiment, the common axis is an axis of circular symmetry of the converging portion and of the duct.

In a particularly advantageous embodiment, the converging portion is a truncated cone having a circular section and having a generator line that makes an angle relative to the axis lying in the range 10° to 15°.

Preferably, the duct is of a length that is greater than 1.7 times the length of the converging portion and preferably greater than 3 times said length.

In a variant, the duct also includes a diverging portion.

It is advantageous for the outlet section of the duct to have a value such that the mean water outlet speed from the duct is greater than 0.1 m/s, in particular greater than 0.3 m/s, and preferably lying in the range 0.5 m/s to 2 m/s.

Preferably, the water inlet flow rate is greater than 1 $m^3$/h.

In an embodiment, the assembly further comprises a pump for feeding the water inlet.

The invention also provides a filter and maintenance group for a swimming pool, the group comprising a water circulation assembly in accordance with the preceding paragraphs, and a filter device.

In a first embodiment, the filter and maintenance group is designed to constitute a fixture in a swimming pool installation.

Above-cited document WO 02/086259 describes a filter method in which a flow-multiplier is incorporated in a pump assembly disposed downstream from the filter assembly. In that way, the filter assembly operates in suction, unlike a sand filter, which operates in pressure.

In that embodiment, valves and pipes connected to the pump assembly make it possible to use a robot for swimming pool maintenance, i.e. a tool that requires a low flow rate at high pressure, and also a cleaner head for collecting debris and dirt.

The use of a cleaner head for cleaning a swimming pool by suction in prior art systems requires the filter and pump circuit to be closed by operating at least one valve, and requires a cleaner-head circuit to be opened by opening at least one other valve. However, the cleaner head is not a simple device since it needs to include an assembly for retaining the collected debris and dirt so that they do not reach the assembly associated with pumping. Drawbacks associated with the pumping system becoming unprimed are also known due to the almost inevitable inflow of air when the cleaner head is put into operation.

It is therefore relatively inconvenient to use such a cleaner head in a swimming pool since it requires operations that are relatively complex and quite a large amount of specialist equipment.

In the first embodiment, the invention provides a swimming pool filter and maintenance group in which it is extremely simple to use a cleaner head. It does not require any valve to be operated and can be provided merely by using an accessory that is simple to make, by making use of the resources of a filter group that has special characteristics.

More precisely, in the first embodiment, the filter and maintenance group for constituting a fixture in a swimming pool installation comprises a pump assembly itself including a circulation assembly of the invention that is disposed between an inlet opening placed partially above and partially below the nominal filling level of the swimming pool, and an outlet opening disposed at the nominal level or close thereto, together with a filter assembly disposed between the inlet opening and the pump assembly.

Preferably, the guide space of the circulation assembly is defined by a Kaplan bend that is connected without discontinuity to the inlet of the converging portion.

In an embodiment of the filter group suitable for use with a suction device used as a cleaner head, the group further comprises: a shutter and coupling element, the shutter-forming portion being for placing upstream from the filter assembly to prevent direct communication between the inlet opening and the filter assembly, and the coupling-forming portion serving to provide direct communication between a flexible hose and the filter assembly; and a bypass duct coupling a first location disposed upstream from at least a fraction of the filter assembly to a second location disposed downstream from the filter assembly but upstream from at least a fraction of the pump assembly, and at which suction exists; the flexible hose being of a length that is sufficient for its end remote from the end coupled to the shutter and coupling element to be capable of being moved to any point in the swimming pool, and of a section that is sufficient to suck up the debris and dirt that is present, possibly also sucking in a large quantity of air without that leading to malfunction.

It is then advantageous for the filter assembly to comprise at least two stages: a coarse first filter stage; and a fine second filter stage; for the shutter and coupling element to be placed upstream from the coarse filter stage, and for the first location to which the bypass duct is coupled to be located between the two stages. Preferably, the first filter stage is constituted by a removable basket having a large working area with orifices of dimension lying in the range 0.1 mm to 0.5 mm. Also preferably, the section of the bypass duct is much less than the inlet section of the converging nozzle of the circulation assembly.

Preferably, the bypass duct is coupled to the filter assembly and to the pump assembly close to the nominal filling level of the swimming pool, and the pump assembly sucks in water coming from the filter assembly at a level that is well below the nominal filling level of the swimming pool.

Preferably, the filter group further comprises a duct having a first end for connection to a swimming pool drain plug, and a second end coupled upstream from the circulation assembly, the duct being provided with a valve disposed close to its second end.

Preferably, the filter group further comprises a shutter for shutting the inlet opening that enables all of the water to be emptied from the filter and maintenance group by the pump assembly, so as to put the group into an over-wintering condition.

Preferably, the pump assembly that sucks in the water leaving the filter assembly comprises a dual pump driven by a single electric motor, comprising a low pressure and high flow rate pump, and a high pressure and low flow rate pump.

Preferably, the outlet opening disposed at the nominal water level or close thereto has an axis that slopes relative to a normal to the swimming pool wall where it is located so that the water it projects has a component that leads to rotating circulation in the swimming pool.

In a second embodiment, the filter and maintenance group is designed to constitute a movable filter group for a swimming pool installation, in which the filter device is a filter that is practically centered on the common axis.

In a variant, the filter is cylindrical and is in the form of a cartridge surrounding the guide space of the circulation assembly, and the converging portion and the duct are placed essentially in line with the cartridge.

In another variant, the filter is cylindrical and is in the form of a cartridge placed essentially around the guide space, the converging portion, and the duct.

In a third embodiment, the filter and maintenance group is for constituting a movable filter group for a swimming pool installation, in which the filter device and the circulation assembly are disposed in a structure provided with a device enabling it to be secured temporarily to a swimming pool wall.

In a first variant, the group includes a water inlet pipe coupling for coupling to a water supply.

In a second variant, the group includes an electric pump feeding the ejector.

Preferably, the entire group is ballasted so as to enable it to float in an orientation such that the water inlet orifice and a water outlet orifice are close to the surface on which the movable group is floating.

In a fourth embodiment, the filter and maintenance group is for constituting a swimming pool cleaner head.

For cleaning swimming pools, both robots and cleaner heads are already known. The term "robot" is used to designate a cleaner appliance that can operate without the presence of any operator, while the term "cleaner head" is used for an appliance that is moved by an operator. A robot differs from a cleaner head in that it includes displacement means enabling it to move over the bottom of a swimming pool.

A cleaner head, sometimes referred to as a "leaf-collector", comprises a body fitted with a long handle, usually a telescopic pole, that is manipulated by an operator from the edge. Such a cleaner head includes a body having a bottom portion that is close to the pool bottom, a suction device possessing an inlet for water under pressure, and a vertical duct going perpendicularly from the center of the body and defining at its bottom end a water inlet, and at its top end a water outlet, with a filter fixed to the top end serving to receive contaminating material, essentially leaves.

A cleaner robot comprises a body fitted with propulsion means (wheels, chains, crawler tracks, belts, water jets, etc.). The propulsion means are driven by a motor device to move the body over the bottom of the swimming pool, with the ability to change direction at the edges of the bottom. The body includes a suction device possessing an inlet for water under pressure and a vertical duct, sometimes in the form of a Venturi, into which water under pressure is injected so as to cause an upward flow of swimming pool water directed towards the filter which is fixed at the top end of the duct. Such a robot also includes a cleaner accessory formed by a flexible hose fitted with a body for rubbing against the bottom of the swimming pool in order to detach contaminating matter.

To feed the pressurized water inlet of a robot or of a cleaner head, and sometimes of other accessories, swimming pool installations deliver a flow of water at moderate pressure (about 0.3 $m^3/h$ to 0.5 $m^3/h$ at a pressure of 1 bar to 5 bar, usually 2 bar to 3 bar, with the flow rate of a given pump decreasing as its pressure increases).

A cleaner head can make use of all of this power, which is of the order of 100 watts (W), solely for suction purposes. A robot has the same power made available to it, but in a robot the flow of water is shared in substantially equal quantities between the functions of propelling the robot, of creating an upflow in the vertical duct, and of driving the cleaner accessory. It can thus be seen that the function of creating an upflow is not very powerful. That is why cleaning a swimming pool requires the robot to operate for many hours, and why it is often performed at night. Since feeding the robot with water requires at least one pump to be used, that can give rise to a noise problem. Above all, this low level of power available for the upflow does not deliver a speed that is sufficient for detaching contaminating material that is firmly stuck to the swimming pool, which is why the cleaner accessory is needed.

It can thus be understood that a cleaner head presents advantages of simplicity, effectiveness, and speed in comparison with a robot. Nevertheless, prior art cleaner heads suffer from a certain number of problems.

Firstly, prior art cleaner heads are not very stable. In order to avoid unduly tiring the operator, they have bodies that are relatively lightweight. As soon as the filter, which is in a high position, begins to fill up with leaves, they tend to make the filter lean over and tilt to one side. Even when the weight of collected material is not very great, the filter tends to cause the cleaner head to tilt towards the side where the bag is located. If this tilting tendency is directed along the axis of the telescopic pole handle, then only moderate effort is required on the part of the operator to compensate the observed effect. However, if the bag tends to tilt sideways relative to the handle axis, then the operator needs to exert greater and greater twisting forces on the handle, which is tiring. Indeed some telescopic poles are incapable of transmitting such a twisting torque, which means that the cleaner head needs to be extracted from the pool very often in order to empty out the bag.

Another drawback of such cleaner heads is that when the bottom of the swimming pool presents a convex shape, it is the central portion of the cleaner head that tends to press against the convex shape which means that strong forces need to be exerted in order to shift the cleaner head. It happens frequently that swimming pool bottoms possess such convex shapes, particularly at the transitions between portions of the swimming pool bottom that are at different depths.

Another drawback of such cleaner heads is that they include a duct that is relatively ineffective in forming the cleaning upflow of water, so their cleaning effect is not very powerful.

In this fourth embodiment of the invention, the cleaner head is very powerful, highly mobile, and very stable.

High power is obtained by a combination of characteristics, firstly with the high flow-multiplication factor obtained by the water circulation assembly of the invention, secondly with the large area over which a fast flow of water travels over the bottom of the swimming pool, said fast flow of water being obtained by forming a thin layer of liquid in the guide space at the bottom surface of the cleaner head, and thirdly with the formation of a peripheral skirt that defines the zone in which the current that is formed acts powerfully.

Great mobility is obtained by using wheels that are placed in such a manner as to avoid any direct contact between the body and the bottom of the swimming pool on a convex portion thereof.

Great stability is obtained by the center of gravity of the cleaner head being lowered by causing the collected contaminated matter to accumulate in a low position of the cleaner head, either directly on the base of the body, or close to the bottom portion of the cleaner head.

More precisely, in the fourth embodiment, the filter and maintenance group is designed to constitute a pool-cleaner head; in which case, the guide space of the circulation assembly is defined by a plane extending substantially perpendicularly to the common axis passing through the upstream section of the converging portion, and by a surface that is substantially parallel to said plane and disposed further upstream.

In an embodiment, the group comprises a body having a base with a bottom surface that is intended to be close to the bottom of a swimming pool constituting a plane that is practically perpendicular to the common axis which is intended to be placed practically vertically, an endpiece for fastening a pole handle to the body, and a filter device surrounding the top portion of the circulation assembly, and the filter device is fastened to the body at the bottom portion thereof.

Preferably, the filter device is fastened to the base.

In a first variant, the filter device is a filter bag having orifices of a size greater than 40 μm, and preferably of about 60 μm.

In a second variant, the filter device is a filter cartridge.

Preferably, the filter device possesses a valve for evacuating air from its top portion.

In an advantageous example, the bottom surface of the base has two substantially parallel sides that are provided with wheels. Preferably, the wheels are disposed in two parallel lines, and each line includes at least three wheels.

Preferably, the space extending between the edges of the base and the inlet of the circulation assembly at the bottom surface is large in area and small in height.

Preferably, the edges of the bottom surface of the base are provided with a skirt, and the skirt is advantageously formed by a member selected from a flexible flap and bristles.

Other characteristics and advantages of the invention will be better understood on reading the following description of embodiments given with reference to the accompanying drawings, in which:

BRIEF DESCRIPTION OF THE DRAWINGS

FIGS. 6A to 6D are diagrams that are described above when explaining the means of the invention;

FIG. 7 is a diagram of a filter fixture for a swimming pool implementing the principles of the invention;

FIG. 8 shows an example of the FIG. 7 filter group being used in an application as a pool-cleaner head;

FIG. 15 is a partially cut-away view of the group of FIGS. 13 and 14, showing how the invention is implemented in a movable assembly; and FIG. 16 is a section view of a movable filter group of the invention that is particularly simple and efficient.

Figure 1:
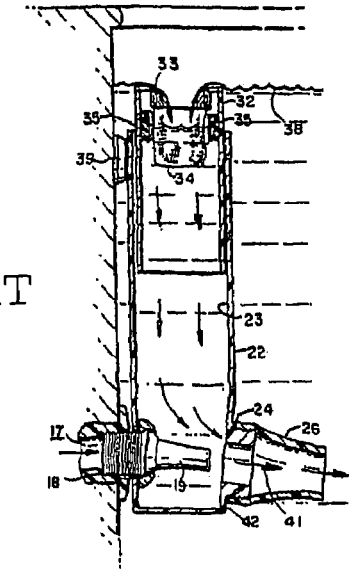
FIG. 1 PRIOR ART
FIGS. 1 to 5 are merely reproductions of a key figure in each of the five above-mentioned prior art documents, and they are described above.
Figure 2:
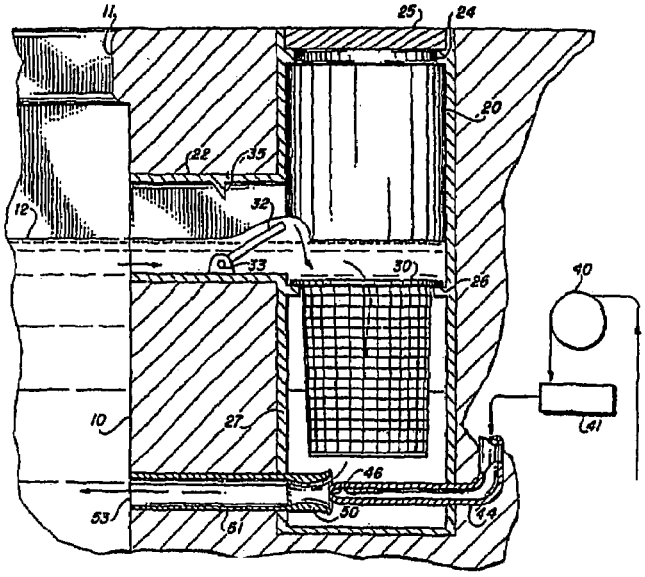
FIG. 2 PRIOR ART
Figure 3:
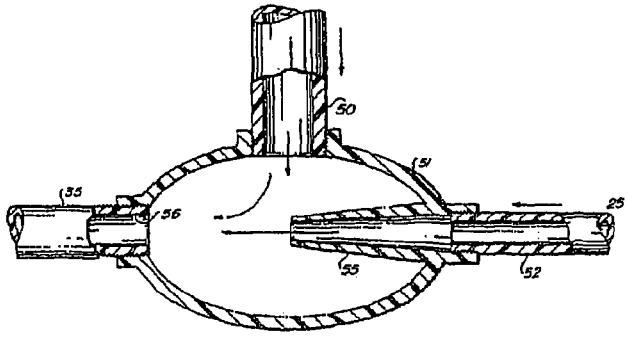
FIG. 3 PRIOR ART
Figure 4:
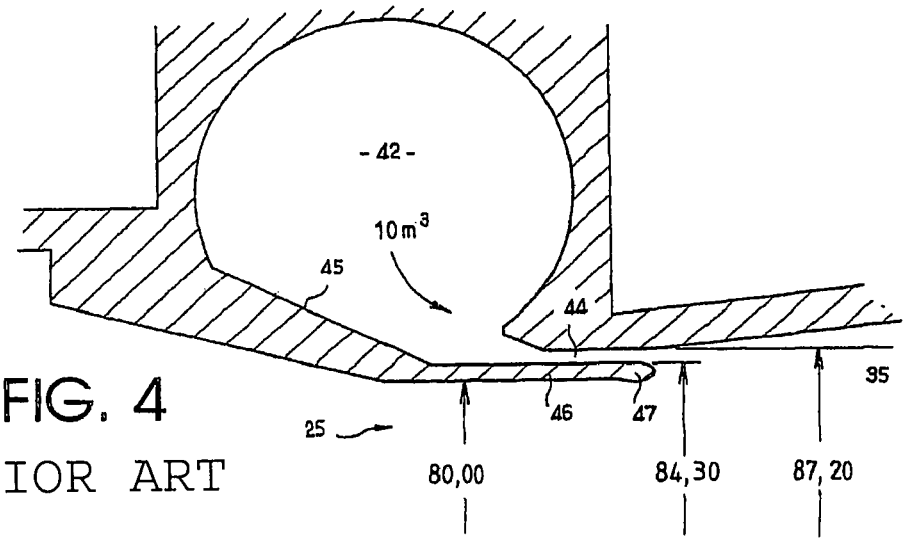
FIG. 4 PRIOR ART
Figure 5:
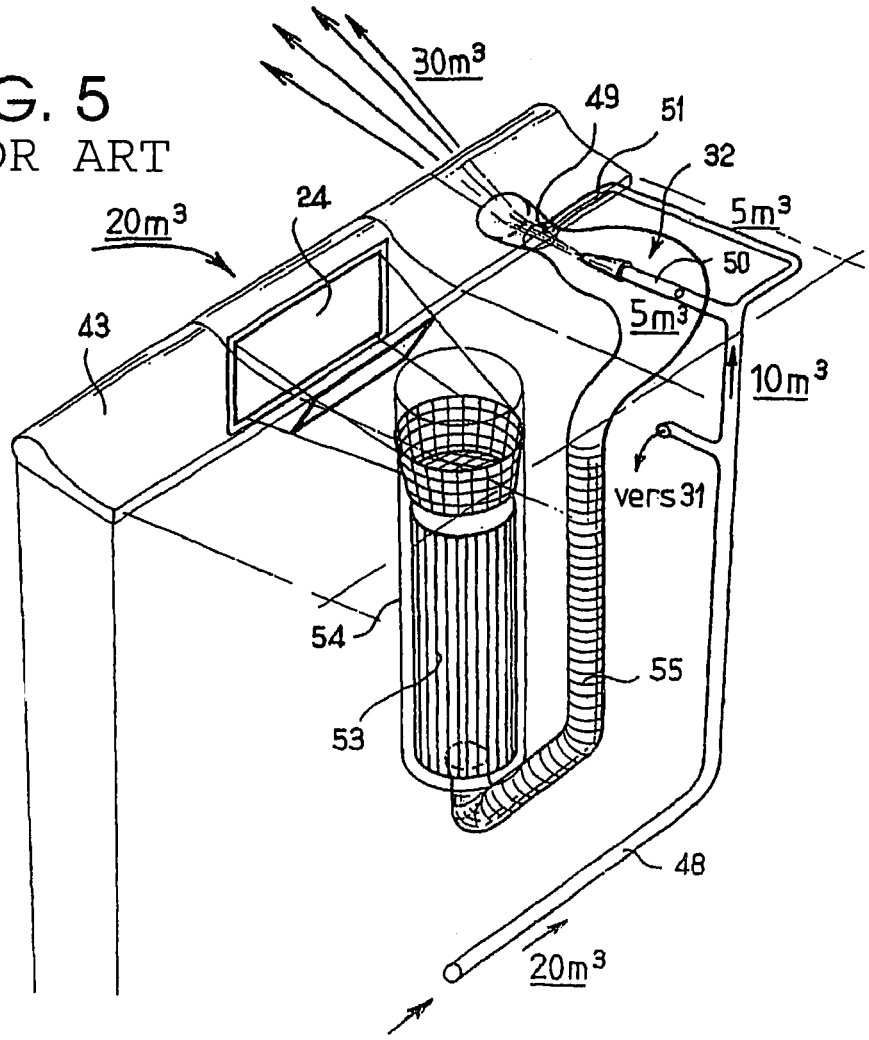
FIG. 5 PRIOR ART

The essential characteristics of the operation of the flow-multiplier water circulation assembly of the invention are described above with reference to FIGS. 6A to 6D.

DETAILED DESCRIPTION OF THE INVENTION

There follows a description of embodiments corresponding successively to the first, fourth, third, and second embodiments, the description being given with reference to FIGS. 7 to 9, 10 to 12, 13 to 15, and 16 respectively.

FIG. 7 is a general view of a filter and maintenance group for a swimming pool constituting the first embodiment of the invention. This group 10 is designed essentially to be placed beneath the nominal level of water in the swimming pool, with this level being identified by reference 12 in FIGS. 7 and 8.

The main elements of this filter group comprise firstly a filter assembly 14, and secondly a pump assembly 16.

More precisely, the top portion of the filter assembly 14 is connected to a space that opens out into the pool via an inlet opening 18 formed by an element known in the art as a skimmer and which may be closed by a plug or a shutter (not shown). The top space also has a top opening 20 that is normally at the level of the ground around the swimming pool, and that is closed by a hatch.

The filter assembly 14 preferably comprises at least two stages, a first stage 22 for coarse filtering, and a second stage 24 for fine filtering.

Preferably, the coarse filter stage 22 allows particles to pass through that are of a dimension smaller than a fraction of a millimeter, and it operates on the principle of a screen filter. For example, this first filter stage 22 is constituted by a basket advantageously formed by a web having orifices of 0.1 mm to 0.5 mm, e.g. 0.3 mm, injection-molded between ribs of plastics material.

The fine second filter stage 24 comprises a cylindrical filter constituted by a non-woven sheet folded concertina-like that is held between two circular end plates and surrounded in one variant by an external non-woven fabric. This second filter stage 24 in this variant constitutes a dual stage formed firstly by the outer non-woven fabric acting as a deep filter and secondly by the concertina-folded non-woven fabric that acts as a surface filter, with filtering fineness that is much greater than that of the outer non-woven fabric.

An advantageous characteristic of the filter assembly shown in FIG. 7 is that the outlet from the filter 24 is at the lowest point of the group and is connected by a duct 26 that is connected to a duct 26 that rises to the nominal water level in the swimming pool.

The pump assembly 16 comprises a pump 28 and a flow-multiplier assembly 30. The pump 28 is advantageously of the type described in general manner by French patent application No. 02/13384. The pump comprises a motor 32, advantageously an electric motor, driving the rotor of a first pump 34 that operates at a high rate (e.g. 14 $m^3/h$) and at low pressure (e.g. 1.4 bar) having its inlet connected to the duct 26 at the lowest portion of the filter group, i.e. close to the outlet from the filter assembly 14. The total flow rate through the pump 34 (e.g. 14 $m^3/h$) is shared between a first outlet 36 (e.g. 12 $m^3/h$) which is connected to the flow-multiplier assembly 30, and a second outlet 38 (e.g. 2 $m^3/h$) which is connected to the second pump 40. This pump 40 raises the pressure of the liquid it receives (e.g. from 1.4 bar), and feeds a pipe 42 that makes it possible to operate a cleaner head or a cleaner robot (e.g. operating at 2.5 bar).

The outlet 38 shown in the form of a separate pipe is nevertheless preferably constituted by an assembly placed all around the electric motor 32 in order to cool it.

The flow-multiplier assembly 30 comprises a converging nozzle followed by a diverging nozzle and an ejector 44 placed immediately upstream from the converging nozzle. Thus, for a flow rate of 12 $m^3/h$ of a pressure of 1.4 bar transmitted by the ejector 44, the flow rate at the outlet from the flow-multiplier assembly 30 is of the order of 36 $m^3/h$, this flow being transmitted to the pool via the outlet opening 48. When the ejector 44 is adapted to the flow rate and to the pressure of the second pump 40 for a flow rate of 2 $m^3/h$ at a pressure of 2.5 bar transmitted by the ejector 44, the flow rate at the outlet from the flow-multiplier assembly 30 is about 30 $m^3/h$, with this flow being transmitted to the pool via the outlet opening 48.

FIG. 8 shows the same filter group, but provided with a shutter and coupling element 50 of the invention.

The element 50 comprises firstly a shutter-forming portion 52 and secondly a coupler-forming portion 54. This coupler-forming portion is for coupling to a flexible hose 56 used as a cleaner head for the swimming pool.

The shutter-forming portion 52 is preferably applied upstream from the filter assembly, and in particular from the first stage 22. For example, this shutter-forming portion 52 is a circular plate provided with tabs enabling it to be blocked by means of a bayonet effect on being turned. Consequently, the major fraction of the suction to the pump 28 passes through the flexible hose 56. While the hose is essentially sucking in water, leaves, and other debris, the water flows normally through the filter, while the leaves and the other debris that have been sucked in are stopped by the basket 22 forming the first filter stage. While the cleaner head is in operation, it serves essentially to suck in water.

According to a characteristic of this embodiment of the invention, when air manages to enter into the filter assembly, via the shutter and coupling element, this air can flow only through the coarse filter portion 22 and not through the fine filter portion 24. A small-section bypass duct 58 is placed between the filter assembly at a location lying between the two filter stages, and the duct 26 leading to the flow-multiplier assembly.

By means of the bypass duct 58, the air sucked in by the flexible tube 58 is prevented from flowing through the fine filter stage 54, but passes via the duct 58 as is exhausted directly by the flow-multiplier assembly.

In the extreme, if the flow rate of the water passing through the filter assembly 24 is less than the nominal flow rate of the pump 28, then the filter group is almost certain to become unprimed.

The bypass duct 58 thus presents the essential advantage of enabling the operation of the cleaner head to be switched on and off merely by installing the shutter and coupling element 50 of the invention. More precisely, the use of the "cleaner head" function given by the hose 56 merely requires the removal of the hatch closing the opening 20 and the installation of the shutter 52 on the filter assembly. From then on, suction is ensured via the flexible hose 56 and continues until the element 50 is removed. At this moment, the filter group starts operating normally again, with flow-multiplication.

The bypass duct 58 presents the auxiliary advantage of enabling a filter basket 22 to be used for retaining debris and dirt without disturbing the fine filter stage 24.

The filter group 10 shown in FIGS. 7 and 8 present numerous other advantages.

Firstly the inlet opening 18 and the outlet opening 48 are located very close to the nominal water level 12 in the swimming pool.

Another advantage of the filter group is that the pump assembly is connected to the bottom portion of the filter assembly, at the lowest point of the installation. Consequently, when the inlet opening 18 is suitably plugged, the pump assembly enables the group to be emptied, e.g. for over-wintering.

The section of the bypass duct is very small compared with the section of the duct 26. In this way, in normal operation, the flow rate of the water passing along the bypass duct and that has been subjected to primary filtering only is very small when it comprises water. The ratio of the sections of the ducts 58 and 26 is preferably less than 1/15, e.g. about 1/25.

Figure 9:
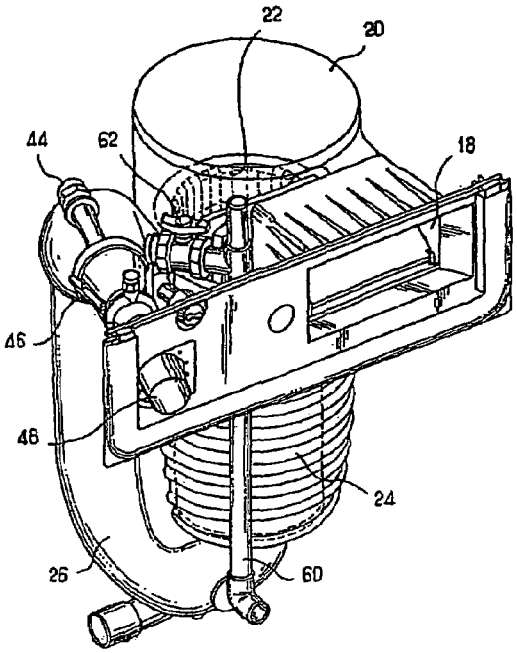
FIG. 9 is a perspective view of an assembly as shown in FIG. 7.

According to an advantageous characteristic of the invention, the outlet 48 which leads to the swimming pool, either directly or via an endpiece, has an axis that is preferably sloped in a horizontal plane relative to a normal to the wall of the swimming pool. This slope of the outlet axis 48 of the flow of water is shown in FIG. 9. In this way, the high-rate flow of water also possesses a large amount of kinetic energy, which is transmitted to the water of the swimming pool with a component that encourages flow in a closed loop at the surface of the swimming pool, and that also encourages stirring of the entire volume of the pool. This closed-loop flow serves to set debris and dirt into motion, thus making them easier to capture by being sucked in through the opening 18 of the skimmer.

The large amount of energy that is transmitted to the water in the pool, creating a flow component causing rotating flow, presents the advantage of ensuring that the water in the pool is stirred thoroughly, and thereby limits or even eliminates zones of stagnation.

This stirring effect is revealed by tests for determining cloudiness. In such tests, extremely fine clay is introduced into the water of the swimming pool, at a concentration of 50 grams per cubic meter of water. This makes the water extremely cloudy. The test consists in determining the effectiveness of filtering by determining the length of time needed for the water to return to a clarity threshold that corresponds to the cloudiness index being reduced by a factor of 4 or even 12 as determined by a turbidity meter.

It is thus found that a return to an acceptable threshold of cloudiness requires less than one day, generally about ten hours, whereas several days are usually required with conventional filtering, and ignoring the formation of a large amount of deposit. This result is achieved firstly because of the high flow rate obtained with the flow-multiplier assembly, for a moderate level of pump power, and secondly by the stirring effect obtained by the turning motion induced by the resultant of the outlet water flow and by its direction, e.g. at 20° relative to the normal to the wall of the swimming pool.

FIG. 9 shows the major fraction of a filter group of the invention as a perspective view, together with various advantageous characteristics. In particular, it can be seen that the housing containing the filter assembly and the duct 26 is constituted by an assembly made by a blow-molding technique, the body containing the filter being preferably ribbed in order to give it good mechanical strength.

In FIG. 9, there can be seen an improvement whereby a duct 60 has a top end opening out firstly to the atmosphere and coupled secondly via a valve 62 to a location situated upstream from the flow-multiplier assembly. Its bottom end is for connection to a drain plug at the bottom of the swimming pool. In this way, it is possible to cause water to flow by suction in this duct at a rate of about 4 $m^3/h$, thus obtaining flow through a drain plug of the swimming pool.

Although it is stated that the bypass duct is connected between the first and second filter stages, it could also be placed entirely downstream from said filter assembly. Under such circumstances, debris can pass via the bypass duct, but since the debris is of small section, it is not very harmful, providing it does not block this duct. Any appropriate device can thus be used for preventing the bypass duct being blocked. In addition, the second end of the duct may be connected to any location where there is suction, e.g. at any point upstream from the converging nozzle of the flow-multiplier assembly.

The filter group of FIGS. 7 to 9 is entirely suitable for swimming pools having a volume of water of the order of 100 $m^3$ to 200 $m^3$. When the volume is greater, a plurality of groups can be used and certain elements can be shared between them, e.g. a pump. When the volume is smaller, it is advantageous to use a group of the movable type, as described below in the present description.

Figure 10:
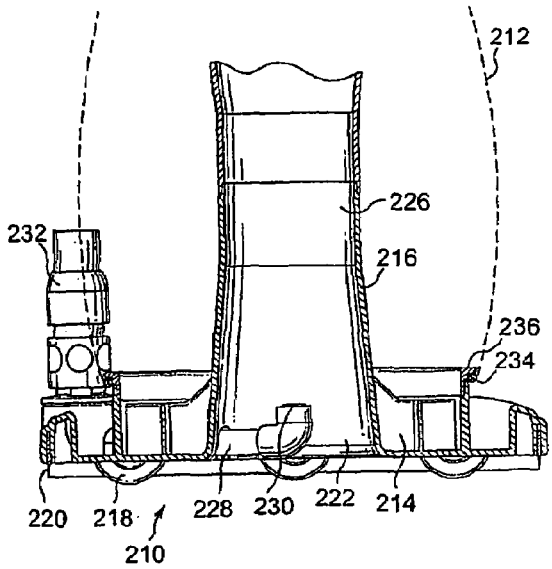
FIG. 10 is a fragmentary section of a pool-cleaner head comprising a flow-multiplier water circulation assembly of the invention.
Figure 11:
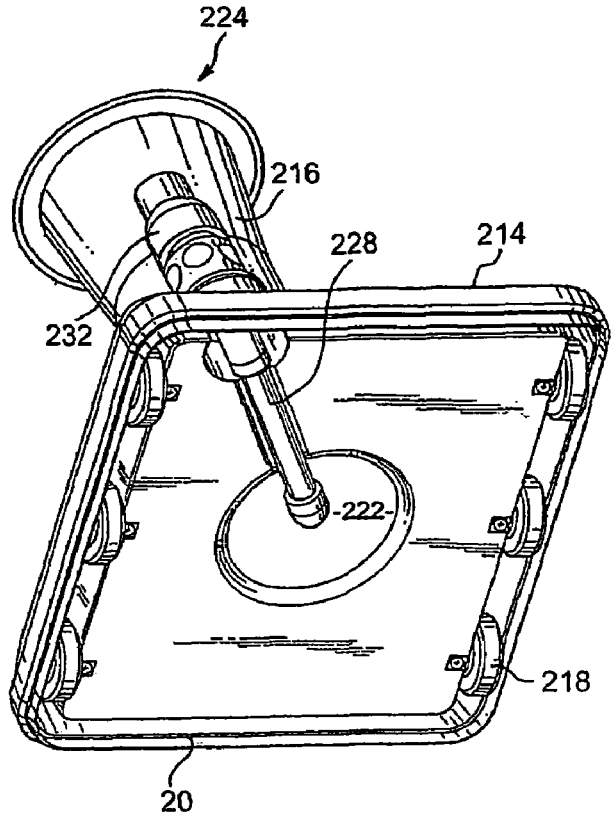
FIG. 11 is a perspective view from below of the FIG. 10 cleaner head.
Figure 12:
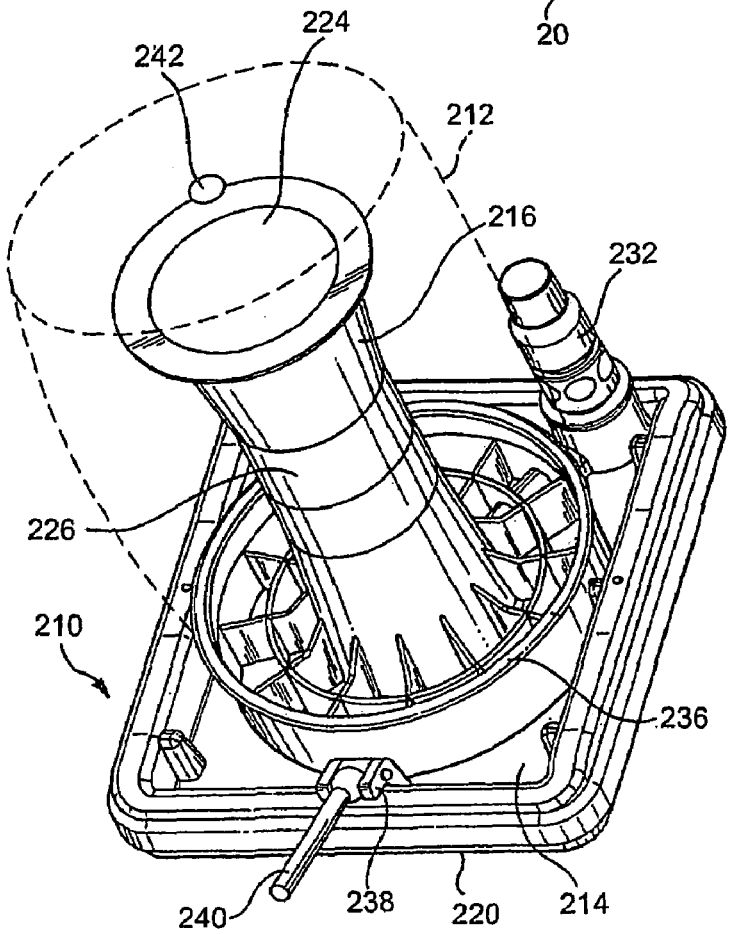
FIG. 12 is a perspective view from above of the cleaner head shown in FIGS. 10 and 11.

In the fourth embodiment, the filter and maintenance groups comprising the circulation assembly of the invention is intended to constitute a pool-cleaner head. FIGS. 10 to 12 are various views of this embodiment of the pool-cleaner head of the invention.

As shown clearly in FIG. 12, the cleaner head essentially comprises a body 210 and a filter 212 shown in the form of a bag in order to simplify the drawing, but which could be a filter cartridge.

The body comprises a base 214 and a duct 216 extending perpendicularly to the base 214. The duct forms part of the water circulation assembly of the invention. The base 214 has wheels 218 organized as two rows of three wheels each in the embodiment shown. A skirt 220, e.g. made of rubber or elastomer, but which could also be made of bristles, is disposed around the entire bottom periphery of the base 214. The duct 216 has a converging portion inlet 222 level with the bottom surface of the base, and has an outlet 224 at its top end. Under such circumstances, the duct 216 is formed by a converging portion, a central portion 226 that is cylindrical, followed by a diverging portion.

A tube 228 is terminated level with the inlet 222 to the converging portion by an ejector 230 for projecting an upward flow of water under pressure as transmitted via an inlet coupling 232. The coupling 232 is for coupling via a flexible hose to a supply of water under pressure as is usually located beside a swimming pool, delivering flow at a rate of about 2 $m^3$/h at a pressure of 1 bar to 5 bar, e.g. in the range 2 bar to 3 bar.

At its top end, the base possesses a collar 236 for retaining a retaining cord 234 located at the opening of the filter bag 212 of the cleaner head.

As shown in FIG. 12, an endpiece 238 having a hinged rod 240 serves for connection to a telescopic pole handle.

Finally, it should be observed that there is a valve 242 at the top portion of the filter bag 212.

In FIGS. 10 and 11, it can be seen that the base 214 co-operates with the surface on which the cleaner head is standing to define a broad and shallow guide space for the circulation assembly that is symmetrical about the inlet to the converging portion (see the large area of the base surrounding the inlet 222 in FIG. 11). It should also be observed that the skirt 220 leaves only a small gap for passing water between the base and the bottom of the pool.

Given that all of the flow of water under pressure (2 $m^3$/h at a pressure of 1 bar to 5 bar) is transmitted to the ejector 230, and given that it is based at the inlet to the converging portion, the suction effect created by the circulation assembly is very large. The sucked-in flow of water begins by flowing in the broad and shallow guide space formed between the bottom surface of the base and the bottom of the swimming pool prior to reaching the converging portion. Since this space is shallow, water flows through it at high speed, thereby producing a significant cleaning effect. This effect is further reinforced at the edges of the cleaner head since the skirt defines a space that is locally very small and thus causes the water to accelerate and take on a high level of kinetic energy against the bottom of the swimming pool.

This very powerful suction effect is easily demonstrated: removing several kilograms of earth thrown into the bottom of a swimming pool requires only a few tens of seconds, and the appliance enables pebbles weighing several tens of grams to be sucked up.

Another characteristic of the cleaner head shown in FIGS. 10 to 12 is that it is highly mobile. The wheels 218 are mounted on ball bearings, preferably stainless bearings, and since they are organized in two rows (extending parallel to the direction of the telescopic pole handle secured to the rod 240 of the endpiece 238), the base itself does not come directly into contact with a convex surface since the wheels in the middle of each row come into contact with convex surfaces and make movement easy.

A very important characteristic of the cleaner head shown in FIGS. 10 to 12 is that it is highly stable. Although its body is made of lightweight plastics material and weighs little, and although the filter bag 212 that is fixed via a cord 234 at its bottom opening around the collar 236 on the base of the body is likewise light in weight, when the sucked-in contaminating material escapes via the outlet 224, it drops back around the duct 216 and accumulates on the base all around the duct. Since the outlet flow of water is directed upwards, it tends to center the top portion of the bag, such that leaves and other waste can fall all around the duct onto the base. The weight of the collected contaminating matter thus constitutes a kind of ballast that increases the stability of the cleaner head. In practice, the accumulation of contaminated matter can be as high as the outlet 224.

Another advantageous characteristic of the invention is that the filter bag 212 is preferably made of a fabric having a mesh size that is greater than 40 μm and preferably equal to about 60 μm. Such a mesh size serves to retain contaminating material even when small, such as small particles of earth, thereby enabling the swimming pool to be cleaned quickly. However, a mesh of this size is so small that air cannot escape from the bag through the fabric; a fabric with a mesh size this small therefore cannot be used with a conventional cleaner head. In the invention, when the filter bag 212 is made using such a fabric, it has an air exhaust valve 242.

Although this characteristic is not shown, the cleaner head may also include, in conventional manner, a cleaning accessory in the form of a flexible tube providing with members for scraping against the bottom of the swimming pool in order to remove matter that is stuck thereto. Such an accessory can easily be mounted on the coupling 232 or on some other location of the tube 228. Nevertheless, such an accessory is generally not needed, unless the pool has not been used for a very long time without being cleaned, so that particularly troublesome dirt has become stuck to the bottom of the swimming pool.

The base is described having a collar 236 for retaining the cord 234 at the opening of the filter bag 212, the collar could be located on the duct close to the inlet, so that contaminating matter constitutes ballast.

Figure 17:
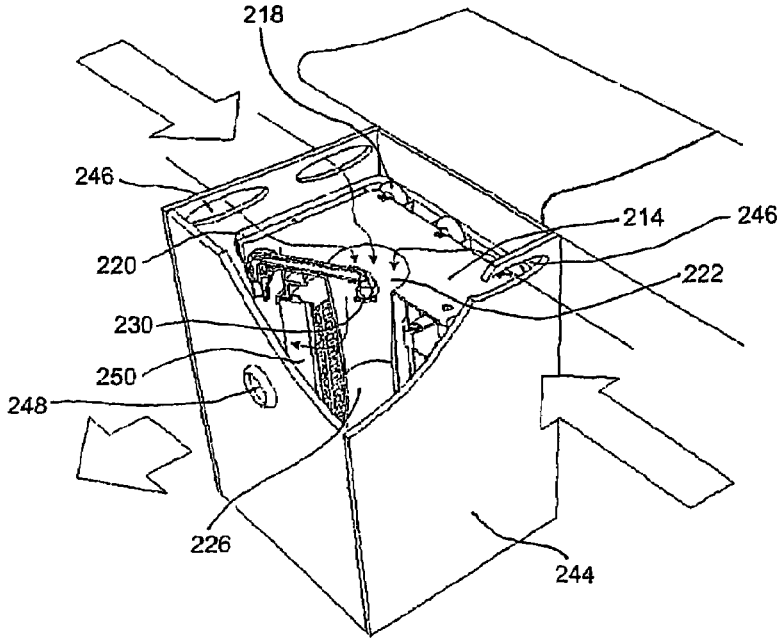
FIG. 17 shows the cleaner head of FIGS. 10 to 12 turned upside down.

Although a filter bag 212 is described above, the bag could advantageously be replaced by a filter cartridge, preferably a cartridge secured to the base and thus increasing its stability, as shown in FIG. 17, described below.

The above-described cleaner head, when provided with a filter cartridge 250 as shown in FIG. 17, can also be used as a filter and maintenance group including a circulation assembly of the invention and serving to constitute a movable or independent group for swimming pool filtering and maintenance. FIG. 17 shows the cleaner head of FIGS. 10 to 12 turned upside-down through 180° and placed in a box 244 having a water inlet 246 level with the pool surface and a water outlet 248. The bag is replaced by a filter cartridge 250 and the assembly constitutes a movable or independent filter group.

Thus, the same combined appliance can be used either as a cleaner head, or as a filter group.

The invention also provides other movable filter groups, as shown in FIGS. 13 to 16.

Figure 13:
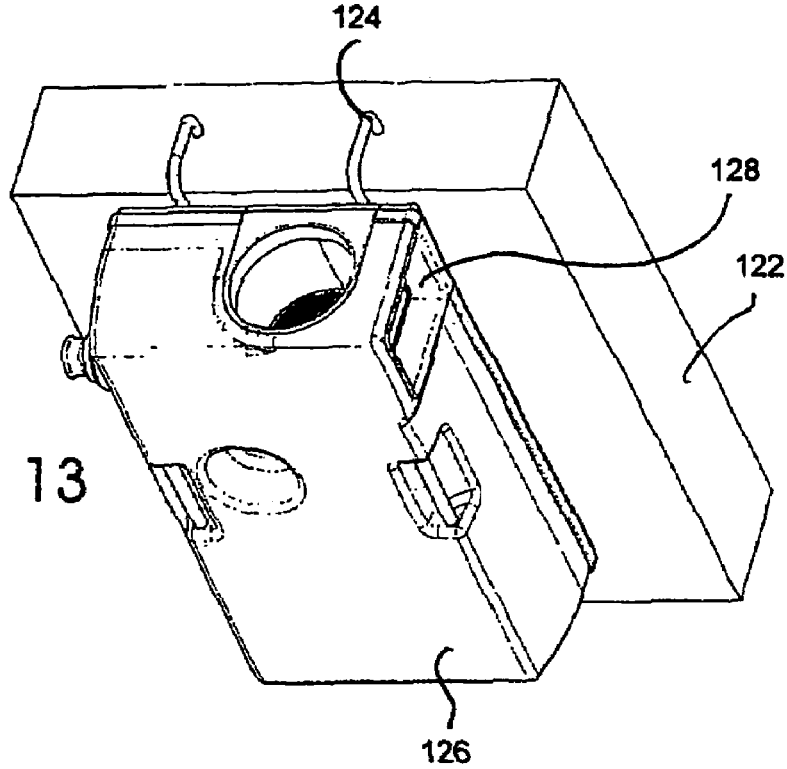
FIG. 13 is a perspective view from above of a movable filter group comprising a water circulation assembly of the invention.
Figure 14:
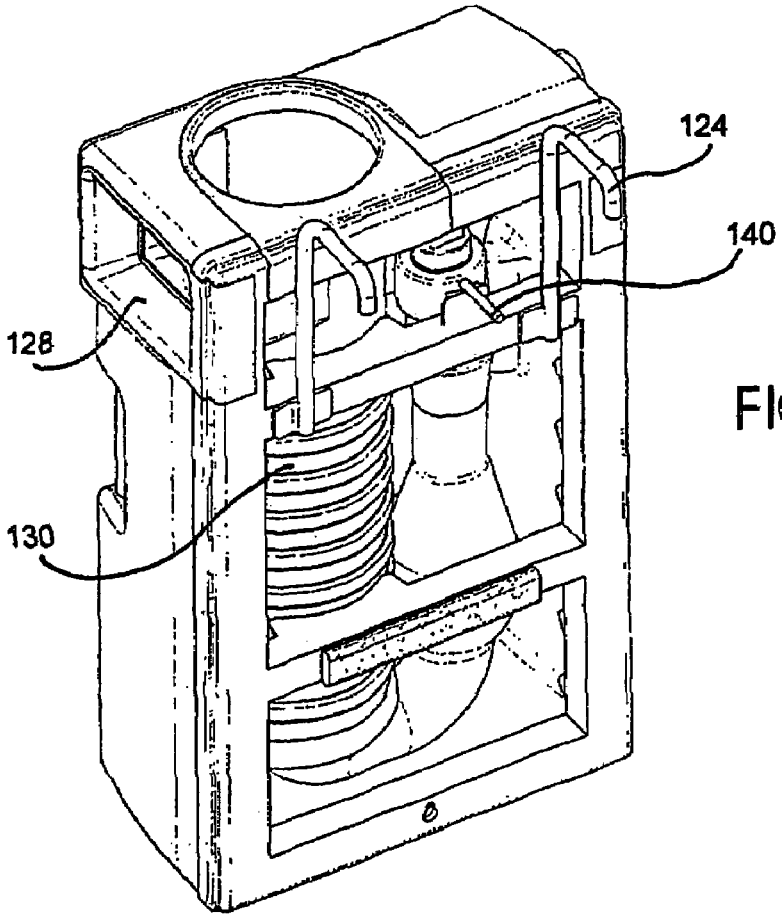
FIG. 14 is a perspective view from behind of the FIG. 13 group.

FIG. 13 shows the top of a portion of a swimming pool wall 122 supporting two hooks 124 that carry the body 126 of a movable filter group.

The movable filter group has a skimmer opening 128 that feeds a vertically-extending filter body 130. Between the bottom portion of the filter 130 and an opening 132 for exhausting water from the filter group, there is disposed a rising duct whose vertical portion includes a converging portion 134 followed by a duct 136 which in the embodiment shown includes a diverging portion. An ejector 138 of the circulation assembly of the invention is disposed on the axis and on the axis of the duct portion 136 practically at the inlet to the converging portion 134. In the example shown, the ejector 138 is fed by a water supply 140 made available in the swimming pool wall.

A bottom orifice 135 enables the group to be emptied so as to make it easy to remove from a swimming pool.

When the wall of the swimming pool has a plurality of water supply points, the movable filter group can be positioned in a variety of locations. In a first variant, one of the hooks 124 (or a swimming pool ladder) can be used for supplying water (or in the variant supplied below for supplying electricity). In this other variant, the group includes a low flow rate and high pressure pump (e.g. at 2 bar or more) e.g. of the electrical type, that is mounted on the body 126 and that sucks water in directly from the pool: no water supply connection is then required.

In FIG. 15, reference 141 designates a three-port valve enabling water to be fed either to the multiplier assembly (ejector 138), or to a pressurized water supply point 139 for feeding an accessory such as a cleaner head.

This movable group presents the advantage of being capable of being moved and of being capable of being used in particular with pools standing on the ground which are generally of smaller volumes than pools dug in the ground. It is made up of solely of elements that are lightweight and inexpensive, and it is easily moved, in particular by using its handles. In addition, it can easily be made in a floating form, and it is preferably ballasted so as to enable it to float with an orientation such that a water inlet orifice and a water outlet orifice are close to the surface of the water on which the movable group is floating.

In the third embodiment, the filter and maintenance group including the circulation assembly of the invention is also intended to constitute a movable or independent swimming pool filter and maintenance group, but it is even more simple than the group constituting the second embodiment. FIG. 16 shows such a movable filter group.

The appliance of FIG. 16 comprises an ejector 142 aligned on an axis and connected to a coupling 144 enabling it to be coupled to a water feed pipe. A duct 146 having a converging portion beside the ejector is placed on the axis of the ejector and is connected thereto by a small number of thin arms 148 serving to support the converging portion and disturbing the flow of water between the ejector and the inlet to the converging portion as little as possible. The ejector and the duct 146 are held by two cheek plates 150 and 152 which also support a cylindrical filter cartridge 154. The cartridge is advantageously held on the inside by a grid 156, e.g. made of plastics material, and another grid 158 is advantageously disposed on the outside so that objects of large size, such as leaves, do not come directly into contact with the filter 154.

While the appliance of FIG. 16 is in operation, as soon as the ejector 142 projects a flow of water along the axis of the duct 146, the water located all around the appliance passes through the grid 158 and the filter 154 and enters into the space that exists between the filter 154 and the duct 146. This water is sucked towards the converging portion from which it flows into the inside of the duct 146.

In testing, the appliance shown in FIG. 16 has been used with pressure at the outlet from the ejector lying in the range 1 bar to 3 bar, and with a flow rate varying over the range 0.5 $m^3/h$ to 3 $m^3/h$. The speed obtained at the outlet from the duct was always greater than 0.2 m/s, and the multiplication factor was always greater than 10.

This movable group presents not only the advantage of being capable of being moved and of being capable of being used in particular in above-ground swimming pools which are generally of smaller volume than pools dug in the ground, like the group in the second embodiment, but it is also lighter in weight, less expensive, and very effective.

The advantages of the movable filter groups of the two last-described embodiments are clear. Thus, a group can be located close to the portion of the swimming pool that is the dirtiest or that is the easiest to access. The group can be inserted into the swimming pool only when necessary. For example, a single group can be used and transported to filter the water in a plurality of swimming pools consecutively. No special apparatus is required other than a water supply or an electricity supply, in particular there is no need for a closed protective space. In addition, because each group is light in weight, a plurality of groups can be located simultaneously in a single pool of large dimensions for the time required to perform filtering. Finally, when the group can float, there is no need for any anchoring device.

The invention claimed is:

1. A flow-multiplier water circulation assembly for a swimming pool, the assembly being of the type including a water inlet and being characterized in that it comprises:

an ejector (110) connected to the water inlet and having a water outlet for projecting water along an ejection axis;

a converging portion (114) having an axis of symmetry and a section perpendicular to said axis that decreases from an upstream section to a downstream section, and presenting a length between the upstream and downstream sections;

a duct (116, 118, 120) disposed in line with the converging portion (114) to which it is connected without internal discontinuity at the downstream section of the converging portion, the duct presenting a length between the downstream section of the converging portion and an outlet, the section of the duct not decreasing in practice along its length, and the length of the duct being not less than one-third the length of the converging portion;

the ejection axis practically coinciding with the axis of symmetry of the converging portion, and the two axes together forming a common axis (112) of the assembly;

the distance between the water outlet of the ejector (110) and the downstream section of the converging portion (114) lying in the range 0.4 times to 1.6 times the length of the converging portion; and a guide space disposed immediately upstream from the upstream section of the converging portion (114) on the common axis (112), and at least as far as the water outlet from the ejector when the outlet is outside the converging portion, said space serving to guide water in practically symmetrical manner around the common axis.

2. An assembly according to claim 1, characterized in that the axis of symmetry of the converging portion is an axis of circular symmetry.

3. An assembly according to claim 2, characterized in that the common axis (112) is an axis of circular symmetry of the converging portion and of the duct.

4. An assembly according to claim 3, characterized in that the converging portion (114) is a truncated cone having a circular section and having a generator line that makes an angle relative to the axis lying in the range 10° to 15°.

5. An assembly according to claim 1, characterized in that the duct (118, 120) is of a length that is greater than 1.7 times the length of the converging portion.

6. An assembly according to claim 1, characterized in that the duct (118, 120) also includes a diverging portion.

7. An assembly according to claim 1, characterized in that the mean water outlet speed from the duct (116, 118, 120) is greater than 0.1 m/s.

8. An assembly according to claim 7, characterized in that the outlet section of the duct is of a value such that the mean water outlet speed from the duct (116, 118, 120) lies in the range 0.3 m/s to 2 m/s.

9. An assembly according to claim 1, characterized in that the water inlet flow rate is greater than 1 $m^3$/h.

10. An assembly according to claim 1, characterized in that it further comprises a pump for feeding the water inlet.

11. A swimming pool filter and maintenance group, characterized in that it comprises a water circulation assembly according to claim 1 together with a filter device.

12. A filter and maintenance group according to claim 11, for constituting a fixture in a swimming pool installation, the group being characterized in that it comprises a pump assembly (16) including the circulation assembly and disposed between an inlet opening (20) placed partially above and partially below a nominal filling level for the swimming pool, and an outer opening (48) disposed at the nominal level or close thereto, and the filter device (14) is disposed between the inlet opening (20) and the pump assembly (16).

13. A filter and maintenance group according to claim 12, characterized in that the guide space of the circulation assembly is defined by a Kaplan bend that is connected without discontinuity to the inlet of the converging portion.

14. A filter and maintenance group according to claim 12, characterized in that it further comprises:

a shutter and coupling element (50), the shutter-forming portion (52) being for placing upstream from the filter assembly (14) to prevent direct communication between the inlet opening (20) and the filter assembly (14), and the coupling-forming portion (54) serving to provide direct communication between a flexible hose (56) and the filter assembly (14); and a bypass duct (58) coupling a first location disposed upstream from at least a fraction of the filter assembly (14) to a second location disposed downstream from the filter assembly (14) but upstream from at least a fraction of the pump assembly (16), and at which suction exists;

the flexible hose being of a length that is sufficient for its end remote from the end coupled to the shutter and coupling element (50) to be capable of being moved to any point in the swimming pool, and of a section that is sufficient to suck up the debris and dirt that is present, possibly also sucking in a large quantity of air without that leading to malfunction.

15. A filter and maintenance group according to claim 14, characterized in that the filter assembly (14) comprises at least two stages: a coarse first filter stage (22); and a fine second filter stage (24); the shutter and coupling element (50) is placed upstream from the coarse filter stage (22), and the first location to which the bypass duct (58) is coupled is located between the two stages.

16. A filter and maintenance group according to claim 15, characterized in that the first filter stage (22) is constituted by a removable basket having a large working area with orifices of dimension lying in the range 0.1 mm to 0.5 mm.

17. A filter and maintenance group according to claim 14, characterized in that the section of the bypass duct (58) is much smaller than the inlet section of the converging portion of the flow-multiplier assembly (30).

18. A filter and maintenance group according to claim 14, characterized in that the bypass duct (58) is coupled to the filter assembly (14) and to the pump assembly (16) close to the nominal filling level (12) of the swimming pool, and the pump assembly (16) sucks in water coming from the filter assembly (14) at a level that is well below the nominal filling level of the swimming pool.

19. A filter and maintenance group according to claim 12, characterized in that it further comprises a duct (60) having a first end for connection to a swimming pool drain plug, and a second end coupled upstream from the circulation assembly, the duct being provided with a valve (62) disposed close to its second end.

20. A filter and maintenance group according to claim 12, characterized in that it further comprises a shutter for shutting the inlet opening (20) that enables all of the water to be emptied from the filter and maintenance group by the pump assembly (16), so as to put the group into an over-wintering condition.

21. A filter and maintenance group according to claim 12, characterized in that the pump assembly that sucks in the water leaving the filter assembly (14) comprises a dual pump (28) driven by a single electric motor (32), comprising a low pressure and high flow rate pump (34), and a high pressure and low flow rate pump (40).

22. A filter and maintenance group according to claim 12, characterized in that the outlet opening (48) disposed at the nominal water level or close thereto has an axis that slopes relative to a normal to the swimming pool wall where it is located so that the water it projects has a component that leads to rotating circulation in the swimming pool.

23. A filter and maintenance group according to claim 11, for constituting a movable group for a swimming pool installation, the group being characterized in that the filter device is a filter that is practically centered on the common axis.

24. A filter and maintenance group according to claim 23, characterized in that the filter is cylindrical and in the form of a cartridge placed essentially upstream from the converging portion and surrounding the guide space.

25. A filter and maintenance group according to claim 23, characterized in that the filter is cylindrical and is in the form of a cartridge placed essentially around the guide space, the converging portion, and the duct.

26. A filter and maintenance group according to claim 11, for constituting a movable group for a swimming pool installation, the group being characterized in that the filter device and the circulation assembly are disposed in a structure provided with a device enabling it to be secured temporarily to a swimming pool wall.

27. A filter and maintenance group according to claim 26, characterized in that it includes a water inlet pipe coupling for coupling to a water supply.

28. A filter and maintenance group according claim 26, characterized in that it includes an electric pump feeding the ejector.

29. A filter and maintenance group according to claim 26, characterized in that the entire group is ballasted so as to enable it to float in an orientation such that the water inlet orifice and a water outlet orifice are close to the surface on which the movable group is floating.

30. A filter and maintenance group according to claim 11, for constituting a swimming pool cleaner head, characterized in that the guide space of the circulation assembly is defined by a plane extending substantially perpendicularly to the common axis passing through the upstream section of the converging portion, and by a surface that is substantially parallel to said plane and disposed further upstream.

31. A filter and maintenance group according to claim 30, characterized in that it comprises a body (210) having a base (214) with a bottom surface that is intended to be close to the bottom of a swimming pool constituting a plane that is practically perpendicular to the common axis which is intended to be placed practically vertically, an endpiece (238) for fastening a pole handle to the body, and a filter device (212) surrounding the top portion of the circulation assembly, and the filter device is fastened to the body (210) at the bottom portion thereof.

32. A filter and maintenance group according to claim 31, characterized in that the filter device (212) is fastened to the base (214).

33. A filter and maintenance group according to claim 31, characterized in that the filter device is a filter bag (212) having orifices of a size greater than 40 μm, and preferably of about 60 μm.

34. A filter and maintenance group according to claim 31, characterized in that the filter device is a filter cartridge.

35. A filter and maintenance group according to claim 31, characterized in that the filter device possesses a valve (242) for evacuating air from its top portion.

36. A filter and maintenance group according to claim 31, characterized in that the bottom surface of the base (214) has two substantially parallel sides that are provided with wheels (218).

37. A filter and maintenance group according to claim 36, characterized in that the wheels (218) are disposed in two parallel lines, and each line includes at least three wheels.

38. A filter and maintenance group according to claim 31, characterized in that the space extending between the edges of the base (214) and the inlet (222) of the circulation assembly at the bottom surface is large in area and small in height.

39. A filter and maintenance group according to claim 38, characterized in that the edges of the bottom surface of the base (214) are provided with a skirt (220).

40. A filter and maintenance group according to claim 39, characterized in that the skirt (220) is formed by a member selected from a flexible flap and bristles.

* * * * *